US010407927B1

(12) United States Patent
Spriggs

(10) Patent No.: US 10,407,927 B1
(45) Date of Patent: Sep. 10, 2019

(54) WAVE GENERATOR SYSTEM

(71) Applicant: Tony L. Spriggs, San Clemente, CA (US)

(72) Inventor: Tony L. Spriggs, San Clemente, CA (US)

( * ) Notice: Subject to any disclaimer, the term of this patent is extended or adjusted under 35 U.S.C. 154(b) by 0 days.

(21) Appl. No.: 15/965,607

(22) Filed: Apr. 27, 2018

(51) Int. Cl.
*E04H 4/00* (2006.01)
*A63B 69/00* (2006.01)

(52) U.S. Cl.
CPC ..... *E04H 4/0006* (2013.01); *A63B 69/0093* (2013.01)

(58) Field of Classification Search
CPC ..... E03H 4/0006; A63B 69/0093
USPC ..... 4/491
See application file for complete search history.

(56) References Cited

U.S. PATENT DOCUMENTS 3,913,332 A * 10/1975 Forsman ..... E04H 4/0006 4/491
2015/0204093 A1* 7/2015 Smythe ..... A63G 21/18 4/491
2017/0226762 A1* 8/2017 Fricano ..... A63B 69/0093
2017/0239580 A1* 8/2017 Immonen ..... A63G 31/007

* cited by examiner

*Primary Examiner* — Huyen D Le
(74) *Attorney, Agent, or Firm* — K. David Crockett, Esq.; Niky Economy Syrengelas, Esq.; Crockett & Crockett, PC

(57) ABSTRACT

A wave generating system.

22 Claims, 7 Drawing Sheets

WAVE GENERATOR SYSTEM

FIELD OF THE INVENTIONS

The inventions described below relate to the field of modular wave generator systems.

BACKGROUND OF THE INVENTIONS

Wave generator systems are used to create desired wave forms for surfers. The process may be used to create waves for competition or merely user enjoyment. The ability to generate consistent waves is advantageous to surfers so that they do not have to wait for a particular wave according to an ocean surfing protocol. In addition, a wave generating system capable of producing consistent waves can be used for surfing competitions, because it can ensure all surfers are afforded the opportunity to ride identical waves to normalize competition.

Though wave generating systems are promising as a technique for generating uniform waves for a user, their use has been hampered by the lack of ability to provide wave generating systems that generate consistent waves, inefficiency in transferring energy to the wave, complexity of design of the pool and foils used to generate wave, and a high cost of installation. These limitations are overcome by the new system described below.

SUMMARY

The devices and methods described below provide for creation of surfable waves of good consistency in an easily fabricated wave generation system. The system has a long pool that contains a trough on one side of the pool, a gutter on the other side of the pool and a stage area between the trough and the gutter. The trough is a deep channel located on one long side of the pool where the depth of the trough is much greater than the depth of the stage area. A plow is drawn through the trough. The action of drawing the plow through water within the trough generates a wave that extends the entire width of the pool over the surface of the stage area and then terminates in the gutter, and travels along the length of the pools as the plow is drawn through the trough. The system can generate a surging wave, a spilling wave, or a plunging wave, or the system can produce a wave which, extending across the stage, includes a surging portion, a spilling portion and a plunging portion.

The "plow" preferably comprises blade or panel comprising a simple flat panel, and is substantially planar and rectangular (at least on its foreword face). The flat panel is inclined from the horizontal, leaning away from the direction of travel. The plow may be mounted on a carriage or sled, or comprise a carriage or sled. The system includes means for pulling the plow through the trough, which can include a cable secured to the plow and attached to a motor driven spool disposed near one or both ends of the trough, so that rotation of the spool results in spooling of the cable on the spool and movement of the plow through the trough. A second spool at the other end of the spool, may also be secured to the plow with a second cable, to be used to pull the plow in the opposite direction through the trough to reposition the plow to create another wave, or, if the plow is reversible so that it may be tilted so that it leans away from the direction of return travel, to create a wave moving along the pool in the opposite direction. The plow may also be driven by a motor secured to the plow and the carriage holding the plow.

The system can be constructed as a permanent or temporary installation. For temporary installations, the system can be constructed of multiple construction panels and other components which can be easily assembled and broken down, and disassembled and moved to different installment sites, such as stadiums, fairgrounds and race tracks. Alternatively, the system may be permanently constructed on a desired site with concrete, earthen works, or other suitable permanent construction materials.

DETAILED DESCRIPTION OF THE INVENTIONS

Figure 1:
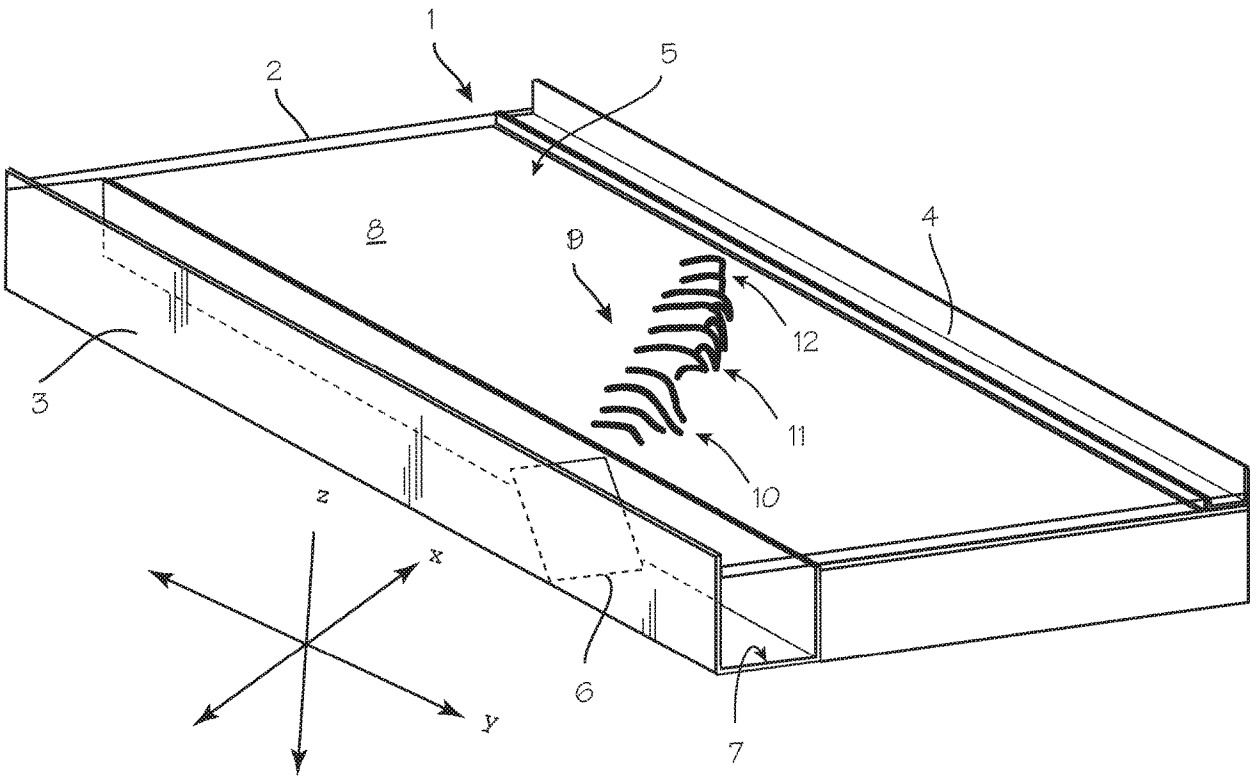
FIG. 1 is a perspective view of a modular wave generating system.

FIG. 1 is a perspective view of a modular wave generating system 1. The components of the system include a pool 2 that has a trough 3 on one side of the pool, and a side gutter 4 on the opposite side of the pool. The gutter may also be provided on the ends of the pool. The pool has a stage area 5 between the trough and the side gutter. (The "stage area" refers to that area of the pool in which surfable waves appear during use.) The pool has opposing long sides along the y-axis. The pool also has opposing end walls along the ends of the pool, generally parallel to the width of the pool (the x-axis) and a bottom surface. The pool also includes a first side wall that defines a first side of the pool and a second side wall that defines a second side of the pool. The trough and the gutter are disposed on opposite long sides of the pool, generally parallel to the length of the pool and the direction in which the wave travels (the y-axis). A plow 6 is disposed within the trough 3, longitudinally translatable within the trough. The plow is disposed within the trough and is operable to be translated longitudinally through the trough along a trough bottom surface 7, along the long side of the pool to generate a surfable wave. (Means for translating the plow through the trough are illustrated schematically in FIG. 3.) The combination of the trough and plow comprise a trough assembly. The plow is preferably a simple blade, comprising a flat panel, characterized by a substantially planar and rectangular foreword-facing surface. The flat panel is inclined from the horizontal, leaning away from the direction of travel. The degree of incline may be 25 to 90 degrees, and may preferably be about 40 to 50 degrees, which may depend on the speed at which the plow is translated, the size of the trough and stage, the depth trough and/or the stage, and the desired wave profile. The plow may be mounted on a carriage or sled. Preferably, the plow is sized, and positioned within the trough, so that the top of the panel is below the surface of the water when drawn longitudinally through the trough at speed, and the outer edge is in close proximity to the outer wall. The upper edge of the panel may extend above the water line when the pool is calm. The stage area 5 is the area of the pool in which the generated wave rises and travels along the length of the pool. The stage is disposed between the first side wall and the second side wall of the pool, and has a bottom surface 8. The stage area may be quite shallow (just a few feet deep) compared to the trough. The bottom of the stage area is preferably higher than the bottom of the trough so that the depth of the stage area is significantly shallower than the depth of the trough.

The wave generated by the system is also illustrated in FIG. 1. The wave extends across the width of the pool, from the trough to the gutter, and travels the entire length of the pool. The wave extends across the stage area over the cross or wide surface (x-plane) of the pool that terminates in the gutter. The wave may be a surging wave extending across the stage, the full width of the stage, or it may be a spilling wave extending across the stage, the full width of the stage, or it may be a plunging wave, extending across the stage, the full width of the stage, or it may be a wave of differing characteristics across the width of the pool. For example, the wave 9 may include a surging portion 10 nearest the plow, which transitions to a plunging portion 11 near the cross-wise center of the stage (as the wave moves over the stage) and finally diminishes to a spilling portion 12 near the gutter, before dissipating on the far side of the pool near the gutter. A spilling portion 13 may also be created between the surging portion and the plunging portion, depending on the movement of the plow and/or the depth of the pool. The spilling portion is the portion in which the top of the wave spills down from the front of the wave, without arching over and ahead of the bottom of the wave. The plunging portion is where the top of the wave arches out ahead of the base of the wave and the surging portion is just a bump, or break, moving through the water. The plunging portion of the wave creates the surfable wave, which can include a tunnel, for competitive surfing. The wave terminates in the gutter and spent water is drawn from the gutter and reintroduced into the stage area (with a pump shown schematically in FIG. 3).

Figure 2:
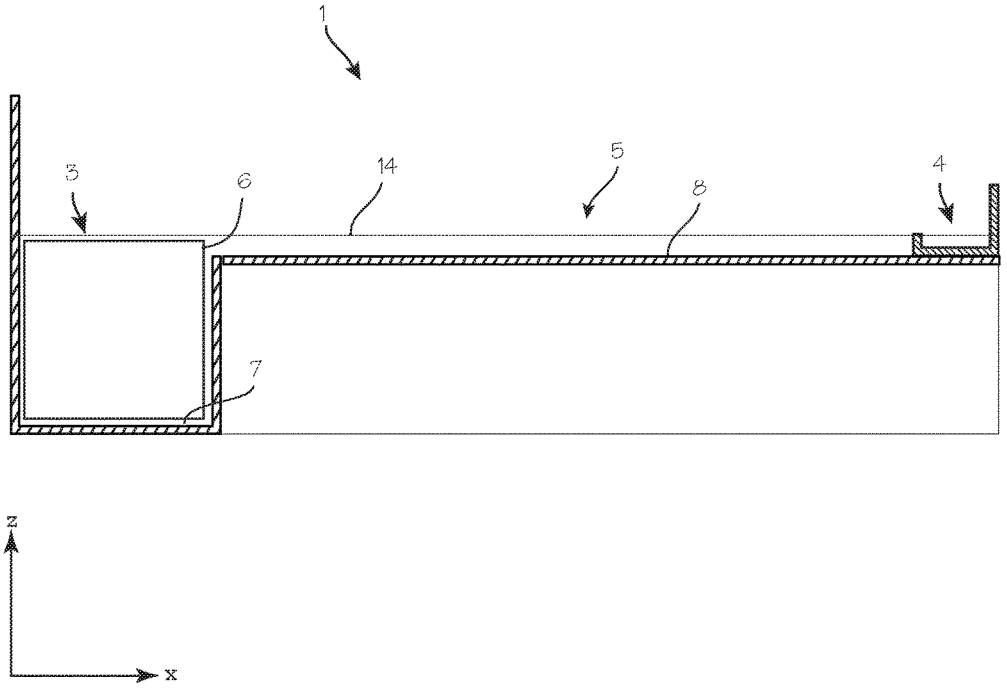
FIG. 2 shows a transverse cross section of the wave generator system.

FIG. 2 shows a transverse cross section of the wave generator system 1. The pool 2 includes the trough 3 on one long side (with the plow 6 disposed in the gutter) and the gutter 4 on the opposing long side of the pool. The stage area 5 is disposed between the trough and the gutter. The stage 5 preferably has planar bottom surface 8, generally parallel to the x-y plane (the horizontal plane, generally parallel to the local flat ground plane). The planar bottom surface of the stage is substantially planar and horizontal and preferably contains no contours or ridges or significant deviations from planarity, as these are unnecessary to produce surfable waves. This view illustrates that the depth of the stage area is small relative to the depth of the trough. In one workable configuration, the trough may be 5 to 20 feet deep, more preferably 10 to 12 feet deep and the stage can be 2 to 5 feet deep. The trough and stage depths may be varied as long as the depth of the stage is less than the depth of the trough. The water line, which is the level of the water in a quiescent pool (when no waves are being generated, and the pool is settled after passage of previous waves) is shown as item 14. As illustrated, the top of the plow is below the water line, but all or some of the upper edge of the plow may extend above the water line. The outer wall of the trough is preferable significantly higher than the water level, so that wave energy created by movement of the plow does not force water over the outer wall and out of the pool.

Figure 3:
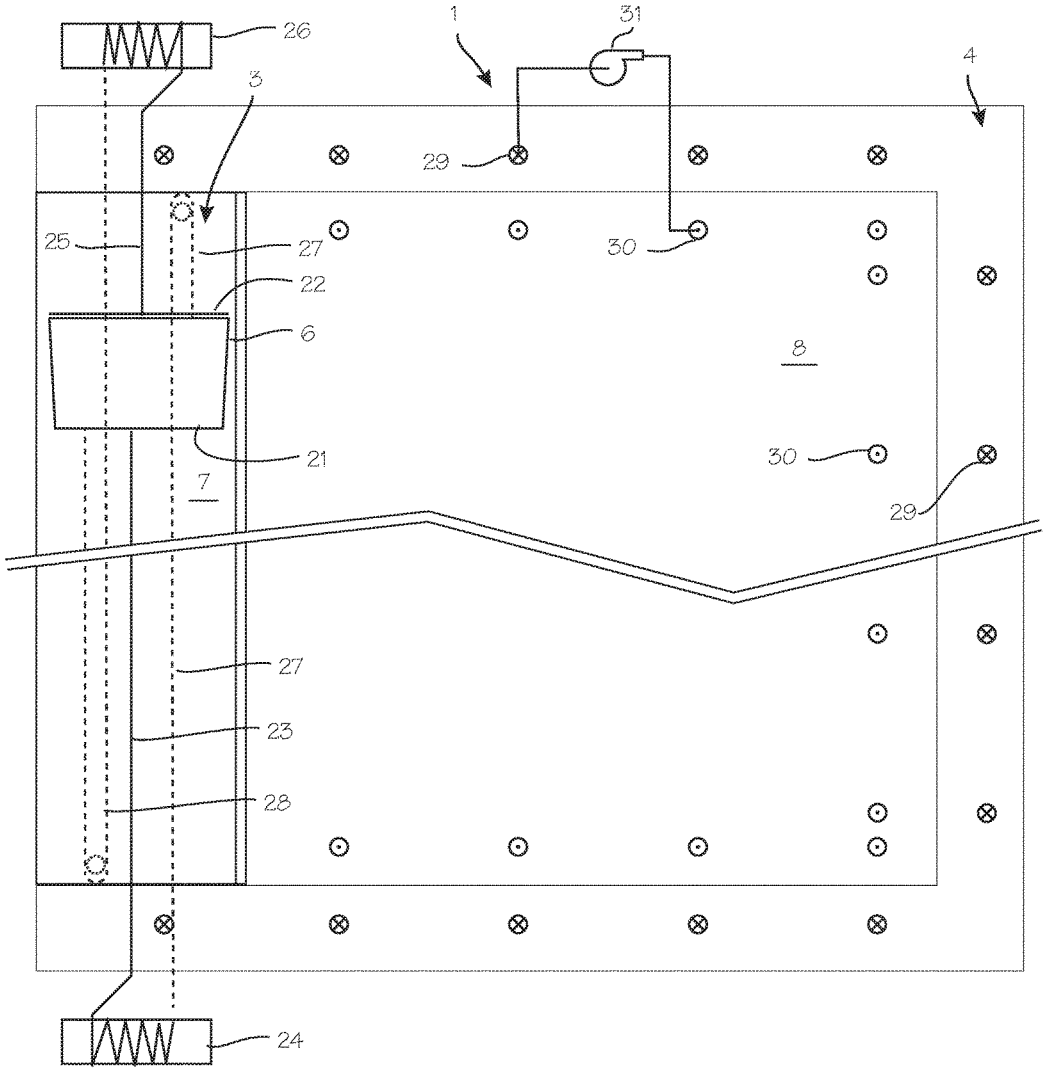
FIG. 3 is a top view of the pool showing the trough, gutter and stage area.

FIG. 3 is a top view of the pool, again showing the trough 3, gutter 4 and stage area 5. The trough is a long and narrow rectangular channel having opposite side walls and a bottom surface 7. A trough outer wall is proximate the first side of the pool, or coincident with the first side of the pool, and a trough inner wall is disposed proximate the stage area. The stage area is bounded on a first side of the pool by the trough and on the second side of the pool by the second side wall. The depth of the stage area is less than the depth of the trough, and the trough inner wall terminates at its upper edge at the same level as the bottom of the stage areas. The plow 6 is translatably disposed within the trough, and may be drawn longitudinally through the trough (along the length of the trough). The plow is connected at a first end 21 and a second end 22 to a plow drive mechanism or other means for translating the plow along the length of the trough. The means for translating the plow may be a motor driven cable and cable spool, a chain drive, or a worm gear drive (including a motor) or any other suitable drive mechanism. Alternatively, the plow may be self-driven by a means for translating the plow comprising drive mechanism disposed within or under the plow or under or within the trough. When the drive mechanism is provided in the form of a spool drive, disposed on the outside the pool, a first cable 23 is secured to the plow and a first cable spool 24 operable to spool the cable is connected to the cable. The cable spool is rotatable to spool or wind the cable upon the spool to pull the plow along the length of the trough. The spool can be located in various locations, including on the plow, under the plow within the trough, or under the trough. The plow drive mechanism may also include a second cable 25 secured to the plow and a second cable spool 26 that is operable to spool the cable to pull the plow along the length of the trough in a direction opposite a direction in which the first cable spool pulls the plow. The first cable spool 24 may be operable to spool the first cable 23 to pull the plow along the length of the trough in a first direction and the second cable spool 26 may be operable to spool the second 25 to pull the plow along the length of the trough in a second direction opposite the first direction. In yet another embodiment, the plow drive mechanism may further include a third cable 27 secured to the plow second end 22 and the first cable spool 24 through a spindle at the first end of the trough, and a fourth cable 28 secured to the plow first end 21 and the second cable spool 26 through a spindle at the second end of the pool, such that the first spool is operable to spool the third cable to pull the plow along the length of the trough in the second direction (opposite the first direction) and the second spool is operable to spool the fourth cable to pull the plow along the length of the trough in the first direction opposite the second direction. (When using a first and second cable secured to a spool, a single spool may be sufficient to pull the plow in both directions.)

The gutter is disposed opposite the trough and may also extend to the ends of the pool. Water flows into the gutters from the dissipating end of the wave, and may be drawn out of the gutter through outlet apertures 29 and pumped and then transported through a return line and reintroduced via return apertures 30 in the bottom or sides of the stage (or in the trough). A pump 31 in fluid communication with the outlet apertures and return apertures may be used to draw water from the gutter and pump it back into the pool.

To create a surfable wave, the plow is translated through the trough at speed, from one end of the pool to the other. The means for translating the plow is preferably operable to draw the plow through the trough at speeds in the range of 20 to 25 feet per second, though the preferred speed may vary greatly depending on the type of waves desired and the dimensions of the pool. After being translated in one direction, drawn or driven longitudinally through the trough, the plow may then be repositioned, moved slowly back to the first end of the pool, in position to again be translated though the trough to generate the next wave. Alternatively, the plow may be turned and reconfigured so that the planar surface faces the first end of the pool, and drawn in the opposite direction (toward the first end of the pool) for generation of a new wave, which travels in the direction opposite the preceding wave. The plow may be manually detached from the drive mechanism and turned around in order to correctly orient it for travel in the reverse direction. Alternatively, the plow may be rotated, through electromechanical mechanisms so that it is repositioned within the trough assembly in order to be drawn in the reverse direction.

Figure 4:
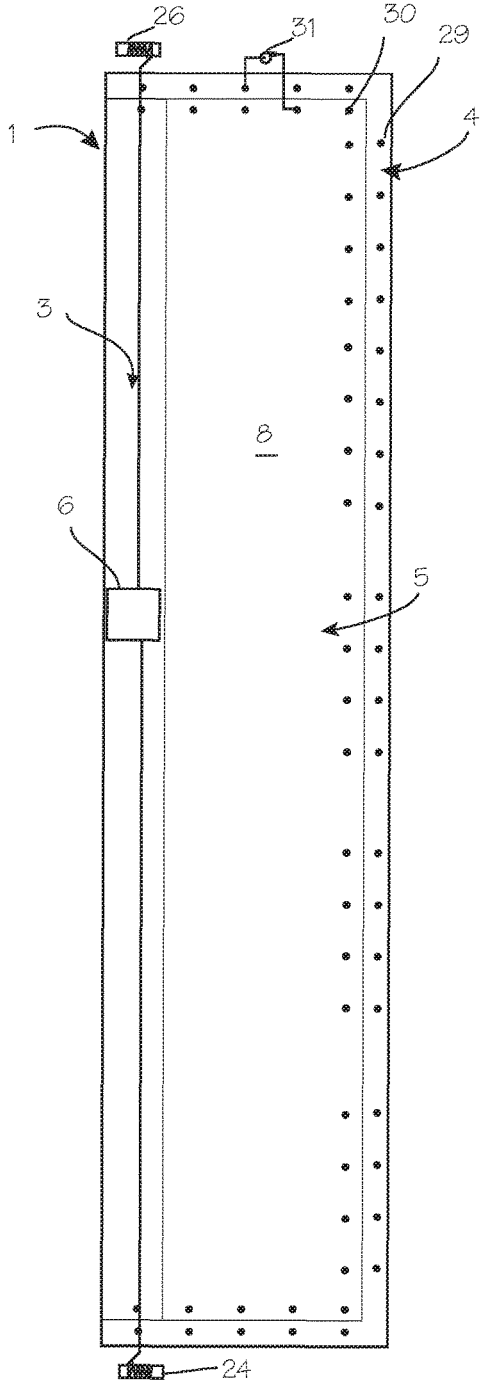
FIG. 4 is a top view of the wave generating system shown in FIG. 3 showing an entire pool, to demonstrate workable dimensions.

FIG. 4 is a top view of the wave generating system shown in FIG. 3 showing an entire pool, to demonstrate workable dimensions. This figure shows the features of FIG. 3 including the trough 3 on one of the side walls and the gutter 4 on the opposite side wall and extending along the end walls, the stage area 5, with its substantially flat bottom 8 is located between the trough and the gutter, and components of the drive mechanisms (in this case, spools 24 and 26) positioned outside the trough assembly and connected to the plow. The pump 31, outlet apertures 29 and return apertures 30 are also shown. This figure illustrates a likely commercial embodiment of the pool with described dimensions. Specifically, for surfing competitions, the elongate sides of the pool may be 312 feet long and 70 feet wide. However, the pool may be sized and dimensioned to fit within the desired user space, or to suit recreational use in smaller spaces.

Figure 5:
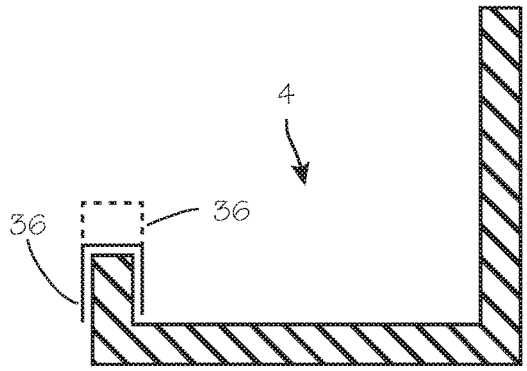
FIGS. 5 and 6 are cross sectional views of the gutter of the system.
Figure 6:
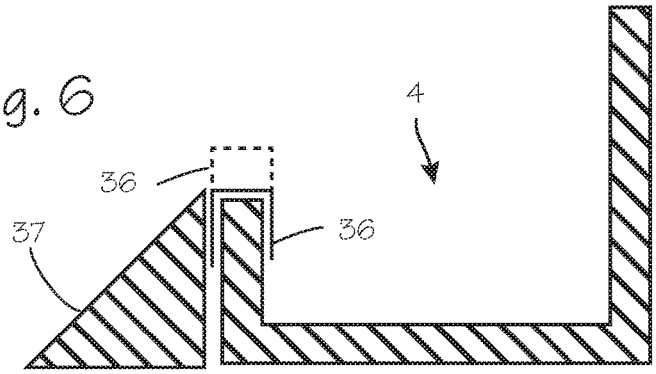

FIGS. 5 and 6 are cross sectional views of the gutter 4 of the system. The gutter extends the entire length of the pool and removes water generated by the wave within the pool and simultaneously returns the water to the inner water containment area. One side of the gutter contains a vertically adjustable weir 36. The weir may be adjusted up and down to control water depth in the stage area. In addition, the weir serves to absorb the energy produced by the wave flows, resulting in reduced backwash on the stage area. Adjustment of the weir results in shortened interval times to produce the next wave. FIG. 6 illustrates a weir with a wedge ramp 37. The use of the ramp, in conjunction with the adjustable weir, modifies the amount of energy absorbed and transferred to the weir and additionally results in reducing backwash on the stage.

Figure 7:
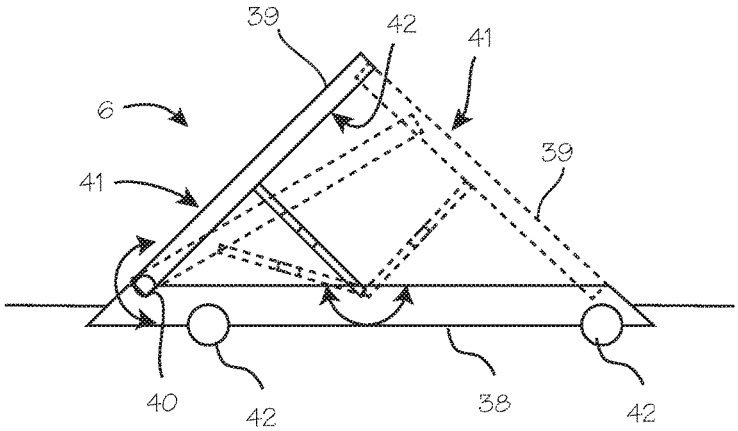
FIGS. 7 and 8 illustrate the plow assembly.
Figure 8:
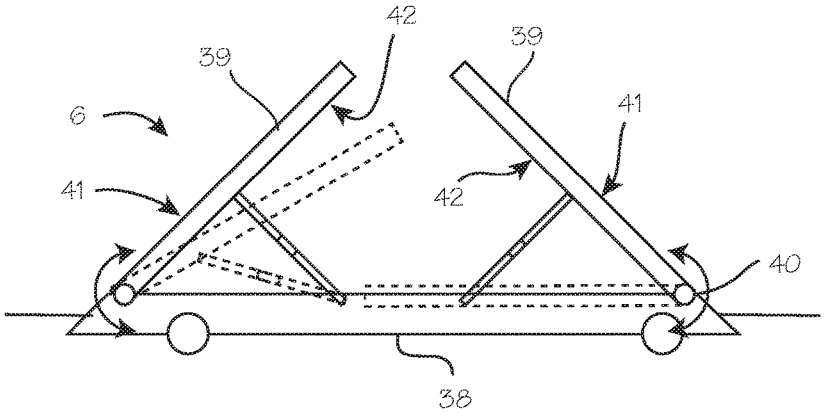

FIGS. 7 and 8 illustrate various embodiments of the plow. FIG. 7 shows a plow having a base 38 connected to a blade or flat panel 39. In this illustration, the base is shown as a carriage (with wheels), though the base may be provided in the form of a sled or it may be configured to slide on rails disposed in the trough. If adjustment of the incline angle of the flat panel forward-facing surface may be desirable in use, the flat panel and the base may be joined through a hinge point 40. The plow includes a panel that has a forward-facing surface 41 facing a direction of travel of the plow through the trough. The forward-facing surface is a substantially flat surface, disposed at an angle, with a width closely matching the width of the trough. The aft-facing surface 42 need not be flat, and may be contoured to limit eddies that inhibit forward motion. The panel may be reversible so that the forward-facing surface may be configured to face either the first end wall or the second end wall. FIG. 7 illustrates a reversible flat panel. The forward-facing panel is positioned for a first direction of travel. Once the plow is drawn through the trough in a one direction, the flat panel may be oppositely rotated on the base so that the flat panel forward facing surface is in the opposite direction. The plow may then be drawn in an opposite direction without requiring repositioned of the base within the trough. When the plow is within the trough, it is positioned so that the flat panel of the plow is disposed at a substantial angle from the horizontal. Once the plow is driven through the trough, it can also be manually removed and repositioned in order to draw the plow in the opposite direction within the trough. As describe above, after being towed or driven through the trough, the plow may be then repositioned, moved slowly back to the first end of the pool, in position to again be translated through the trough to generate the next wave. Alternatively, the flat panel may be rotated and reconfigured to that the planar surface faces the first end of the pool, so that it may be drawn in the opposite direction (toward the first end of the pool) for generation of a new wave which travels in the direction opposite the preceding wave. The plow may be detached from the drive mechanism and turned around in order to correctly orient it for travel in the reverse direction. Alternatively, the entire plow assembly, including the base and flat panel, may be rotated, through electromechanical mechanisms, so that it is repositioned within the trough assembly in order to be drawn in the reverse direction.

FIG. 8 illustrates another plow assembly with a flat panel on each end of the base. Only one flat panel (the leading flat panel which is forward, relative to the direction of travel) need be elevated when the plow is drawn through the trough, and the other flat panel (the trailing flat panel, which is aft (relative to the direction of travel)) may be laid flat on the base, or left in the inclined position. At the completion of one drive across the trough in a first direction with one flat panel in a raised position, the flat panels may be altered so that the other plate is elevated in order to create a wave when the plow is translated in the opposite direction within the trough. The base may contain wheels 43 so the plow may be drawn between the elongate sides of the trough via wheels, and the bottom of the trough may be provided with tracks to maintain alignment of the plow within the trough.

Figure 9:
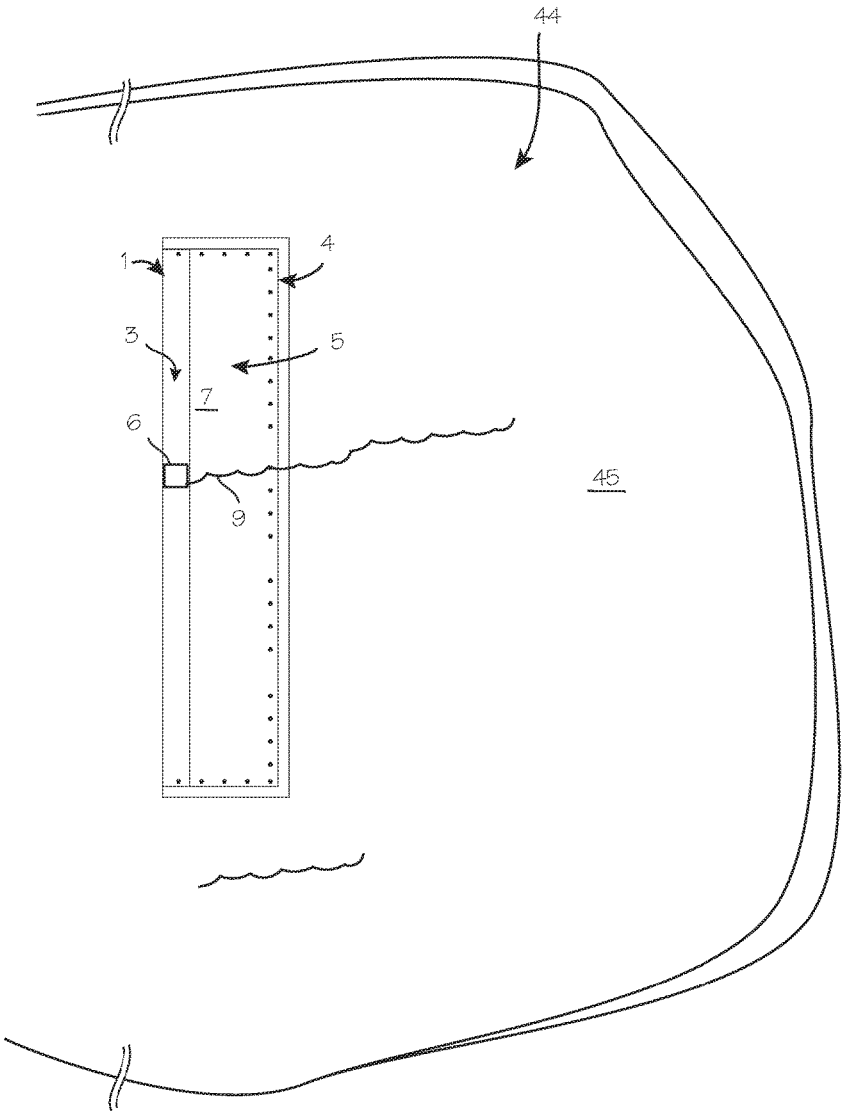
FIG. 9 illustrates a wave generating system in a lake or pool.

FIG. 9 illustrates a top view of a wave generating system in a lake or pool 44. The wave generating system includes a trough 3 on one side of the system and, optionally, a gutter 4 on the opposing side. The stage area 5 is defined between the trough and the gutter or opposing side. In an embodiment where the gutter is not included, the opposite side of the trough may include a vertically adjustable edge to vary the water level. As in the previously described embodiments, the stage has a planar bottom surface 7 with no significant contours or ridges, and the depth of the stage area is small relative to the depth of the trough. The trough contains the plow that is longitudinally translatable within the trough. The bottom of the stage area, or the sides of the pool, may include apertures 29 open to the lake or pool, for return of any water spilled from the pool by the waves generated by the pool, to maintain the quiescent water level. The apertures in the stage bottom may be used to allow return flow, as long as the apertures are not large enough to disrupt wave generation. A pump may be included to maintain the quiescent water level, as illustrated in FIGS. 3 and 4, and the quiescent water level may be maintained above or below lake water level, by pumping water from the lake back into the stage. Translation of the plow through the trough generates a wave that travels from the trough, over the stage area, and over the edge of the pool and further over the lake. The wave is initially a surging wave that transitions to a plunging and finally a spilling wave across the stage, but may dissipate outside the pool. The diminished wave may extend beyond the stage area into the lake, on both the long side of the pool and the ends of the pool. This results in smaller or light waves in the lake water outside of the wave generating system. The waves in the stage area generate surfable plunging waves, while the waves in the beach area 45 dissipate into waves that are swimmable or sufficient for teaching beginning surfers how to surf.

Referring again to FIG. 9, the system may be constructed using natural features of the lake. Where a lake bottom is sufficiently flat, the trough assembly can be placed in the lake without need for a manufactured stage area. The lake bottom (natural or dredged to flatness) can serve as the stage. In this configuration, the wave may be generated in the trough assembly and may travel over the lake bottom and continue over the lake to produce light surging waves close to the edge of the lake opposite the trough, as well as the more energetic surging, plunging and spilling waves near the trough.

The pool 2 may be formed of various materials. For example, the pool may be constructed of numerous construction panels of wood, plastic or glass, supported by any necessary structures and sealed together, if necessary. Alternatively, the pool may be permanently constructed on a desired site with concrete, earthen works, or other suitable permanent construction materials. Thus, the pool can be a permanently constructed pool or alternatively, it may be a temporary structure that is erected on site for short term use. The trough may be set on level ground, and the stage area may be elevated above the ground, or the stage area may be set on level ground, and the trough may be dug into the ground. The pool surfaces may be covered with a waterproof membrane to minimize leakage of the water from the pool. The pool is preferably constructed in an orientation where wind (or prevailing winds) would flow along the length of the pool (in the case of a system designed for wave travel in only one direction, it would be preferable to orient the pool such that prevailing winds blow into the face of the waves). This orientation ensures that strong cross winds (winds traveling across the width of the pool) do not interfere with the formation of the waves.

While the plow has been described as rectangular and also referred to as a flat panel, this refers to a preferred embodiment. While the plow formed of a simple sheet of plywood will produce good surfable waves, the plow need not be strictly rectangular or strictly planar. Substantially flat panels will produce good surfable waves, and panels which are rectangular, rectangular with rounded corners, rhomboid, or even oval will produce good surfable waves, and panels with slight deviations from flatness may produce good surfable waves. However, complex foil shapes are unnecessary. The contour of the pool bottom in the stage area, likewise, need not be perfectly flat, and need only be substantially flat so that the bottom contour does not disrupt wave formation. The bottom contour in the stage area preferably has no significant incline relative to the horizontal plane, and preferably has no reef-like contour, so that construction, especially temporary construction, is greatly simplified. The overall shape of the pool has been described as rectangular, but again, it need not be perfectly rectangular, and device may deviate substantially from the rectangular form depicted in the drawings, so long as the pool is long enough, and travel of the plow is sufficient, to generate surfable waves.

Also, the benefits of the plow with a substantially flat forward-facing surface can be obtained in combination with the benefits of the substantially flat-bottomed stage area, or each of these features may be employed without the other to obtain the benefit of each feature without the benefit of the other feature. Likewise, the benefits of the trough configuration may be achieved in combination with the benefits of the flat plow and/or substantially flat-bottomed stage area, or in isolation, and the benefits of the flat-bottomed stage area may be achieved in combination with the benefits of the flat plow and/or the deeper trough, or in combination with the plow without the benefit of the deeper trough, or in combination with the deeper trough and plows of differing configurations.

While the preferred embodiments of the devices and methods have been described in reference to the environment in which they were developed, they are merely illustrative of the principles of the inventions. The elements of the various embodiments may be incorporated into each of the other species to obtain the benefits of those elements in combination with such other species, and the various beneficial features may be employed in embodiments alone or in combination with each other. Other embodiments and configurations may be devised without departing from the spirit of the inventions and the scope of the appended claims.

I claim:

1. A wave generating system comprising:

a pool having a length and a width, a bottom surface, a first end wall and a second end wall, and a first side wall defining a first side of the pool and a second side wall defining a second side of the pool;

a stage area disposed between the first side wall and the second side wall of the pool, said stage area having bottom surface;

a trough running along the first side of the pool, said trough having a width and a length, a trough bottom surface, a trough outer wall proximate or coincident with the first side of the pool, and an inner wall disposed proximate the stage area, such that the stage is bounded on first side of the pool by the trough and on the second side of the pool by the second side wall;

wherein the depth of the stage area is less that the depth of the trough, and the trough inner wall terminates at its upper edge at the same level as the bottom of the state area; and a plow disposed within the trough, and operable to be translated through the trough, along the length of the pool.

2. The wave generating system of claim 1, wherein:

the bottom surface of the stage area is substantially planar and horizontal.

3. The wave generating system of claim 1, wherein:

the bottom surface of the stage area is substantially planar and horizontal, without contours, ridges or significant deviations from planarity.

4. The wave generating system of claim 1, wherein:

the plow comprises a panel with a forward-facing surface facing a direction of travel of the plow through the trough, wherein the forward-facing surface is a substantially flat surface, disposed at an incline, with a width closely matching the width of the trough.

5. The wave generating system of claim 4, wherein:

the substantially flat surface is rectangular.

6. The wave generating system of claim 1, further comprising:

means for translating the plow along the length of the trough.

7. The wave generating system of claim 6, wherein:

the means for translating the plow along the length of the trough comprises a cable secured to the plow assembly and a cable spool operable to spool the cable to pull the plow along the length of the trough.

8. The wave generating system of claim 7, wherein:

the means for translating the plow along the length of the trough comprises a first cable secured to the plow assembly and a first cable spool, operable to spool the first cable to pull the plow along the length of the trough.

9. The wave generating system of claim 8, wherein:

the means for translating the plow along the length of the trough comprises a second cable secured to the plow assembly and a second cable spool, operable to spool the cable to pull the plow along the length of the trough in a direction opposite a direction in which the first cable spool pulls the plow.

10. The wave generating system of claim 8, wherein:

the panel is reversible, such that the forward-facing surface may be configured to face either the first end wall or the second end wall.

11. The wave generating system of claim 7, wherein:

the means for translating the plow along the length of the trough comprises a first cable and a second cable secured to the plow assembly and a first cable spool, operable to spool the first cable to pull the plow along the length of the trough in a first direction and operable to spool the second cable to pull the plow along the length of the trough in a second direction opposite the first direction.

12. The wave generating system of claim 7, wherein:

the means for translating the plow along the length of the trough comprises a third cable and a fourth cable secured to the plow assembly and a second cable spool, operable to spool the third cable to pull the plow along the length of the trough in the second direction and operable to spool the fourth cable to pull the plow along the length of the trough in the first direction opposite the second direction.

13. The wave generating system of claim 7, wherein:

the means for translating the plow along the length of the trough comprises a drive mechanism disposed within or under the plow.

14. The wave generating system of claim 7, wherein:

the means for translating the plow along the length of the trough comprises a drive mechanism disposed under or within the trough.

15. The wave generating system of claim 1, wherein:

in a quiescent condition, with water in the pool, the stage area is 2 to 5 feet deep, and the trough is deeper that the stage area and is 5 to 20 feet deep.

16. The wave generating system of claim 1, further comprising:

a gutter running along the second side of the pool.

17. The trough assembly of claim 1 wherein the channel depth is at least 14'.

18. A wave generating system comprising:

a pool having a length and a width, a bottom surface, a first end wall and a second end wall, and a first side wall defining a first side of the pool and a second side wall defining a second side of the pool;

a stage area disposed between the first side wall and the second side wall of the pool, said stage area having bottom surface;

a plow disposed along the first side of the pool, and operable to be translated through the pool, along the length of the pool;

wherein the bottom surface of the stage area is substantially flat and horizontal substantially planar and horizontal, without contours, ridges or significant deviations from planarity.

19. A trough assembly for generating waves in the wave pool comprising:

a channel having opposite parallel sides and a planar bottom surface;

a plow having a base with a first end and a second end, a blade and a hinge on one end of the base, wherein the blade is pivotally connected to the base at the hinge;

a spool having a cable connected to the plow; and a motor for driving the spool that draws the plow through water contained within the trough assembly;

wherein the cable maintains the plow at a substantial angle from the bottom planar surface as it is drawn through the trough assembly.

20. The trough assembly of claim 19 wherein the plow base further comprises wheels.

21. The trough assembly of claim 20 further comprising a track on the bottom planar surface for rolling the plow via the wheels through the trough assembly.

22. The trough assembly of claim 19 wherein the blade is rectangular.

* * * * *